US012612925B2

(12) United States Patent
Lodge et al.

(10) Patent No.: US 12,612,925 B2
(45) Date of Patent: Apr. 28, 2026

(54) ROTOR BLADE FOR A TURBOMOLECULAR VACUUM PUMP

(71) Applicant: Edwards Limited, Burgess Hill (GB)

(72) Inventors: Samuel David Lodge, Burgess Hill (GB); Declan Wilcock, Bristol (GB)

(73) Assignee: Edwards Limited, Burgess Hill (GB)

( * ) Notice: Subject to any disclaimer, the term of this patent is extended or adjusted under 35 U.S.C. 154(b) by 0 days.

(21) Appl. No.: 18/862,379

(22) PCT Filed: May 4, 2023

(86) PCT No.: PCT/GB2023/051176
§ 371 (c)(1),
(2) Date: Nov. 1, 2024

(87) PCT Pub. No.: WO2023/214169
PCT Pub. Date: Nov. 9, 2023

(65) Prior Publication Data

US 2025/0297615 A1 Sep. 25, 2025

(30) Foreign Application Priority Data

May 4, 2022 (GB) ..... 2206492

(51) Int. Cl.
*F04D 29/38* (2006.01)
*F04D 19/04* (2006.01)

(52) U.S. Cl.
CPC ..... *F04D 29/384* (2013.01); *F04D 19/042* (2013.01)

(58) Field of Classification Search
CPC ..... F04D 29/384; F04D 19/042; F04D 19/04; F04D 29/386
See application file for complete search history.

(56) References Cited

U.S. PATENT DOCUMENTS 5,358,373 A * 10/1994 Hablanian ..... F04D 19/042 415/199.5
2011/0064562 A1* 3/2011 Oishi ..... F04D 29/324 415/62

(Continued)

FOREIGN PATENT DOCUMENTS

DE 102016118038 A1 12/2016
GB 2583938 A 11/2020

(Continued)

OTHER PUBLICATIONS

British Search Report dated Oct. 11, 2022 for corresponding British application Serial No. GB2206492.7, 4 pages.

(Continued)

*Primary Examiner* — Aaron R Eastman
(74) *Attorney, Agent, or Firm* — Theodore M. Magee; Westman, Champlin & Koehler, P.A.

(57) ABSTRACT

The present disclosure relates to a rotor blade for a turbomolecular vacuum pump. The rotor blade has a blade angle of 0° at the root, which increases continuously along substantially the entire span of the rotor blade. The rotor blade tapers from a maximum thickness at the root to a point of minimum thickness over a portion of its span, and is made of a polymer material reinforced with short fibres. This provides a rotor blade with a more complex geometry that has reduced weight and improved performance and cost-effectiveness. The present disclosure also relates to a rotor comprising the rotor blade, a mould for injection moulding the rotor blade or rotor, and a method of injection moulding the rotor blade or rotor.

17 Claims, 4 Drawing Sheets

(56) References Cited

U.S. PATENT DOCUMENTS

| | | | | |
|---|---|---|---|---|
| 2013/0045094 | A1 | 2/2013 | Giors et al. | |
| 2018/0363662 | A1 * | 12/2018 | Kabasawa | F04D 29/324 |
| 2020/0232475 | A1 * | 7/2020 | Azzouz | F04D 25/066 |

FOREIGN PATENT DOCUMENTS

| | | | | |
|---|---|---|---|---|
| JP | H01195992 | A | 8/1989 | |
| JP | 2019035344 | A | 3/2019 | |
| WO | 2008136084 | A1 | 11/2008 | |
| WO | WO-2011092674 | A1 * | 8/2011 | F04D 27/0246 |
| WO | WO-2013110936 | A2 * | 8/2013 | F04D 19/04 |

OTHER PUBLICATIONS

PCT Notification of Transmittal of the International Search Report and the Written Opinion of the International Searching Authority, or the Declaration and PCT Search Report dated Aug. 10, 2023 for corresponding PCT application Serial No. PCT/GB2023/051176, 6 pages.

PCT Written Opinion dated Aug. 10, 2023 for corresponding PCT application Serial No. PCT/GB2023/051176, 6 pages.

* cited by examiner

ROTOR BLADE FOR A TURBOMOLECULAR VACUUM PUMP

CROSS-REFERENCE OF RELATED APPLICATION

This application is a Section 371 National Stage Application of International Application No. PCT/GB2023/051176, filed May 4, 2023, and published as WO 2023/214169 A1 on Nov. 9, 2023, the content of which is hereby incorporated by reference in its entirety and which claims priority of British Application No. 2206492.7, filed May 4, 2022.

FIELD

This disclosure relates to a rotor blade for a turbomolecular vacuum pump. This disclosure also relates to a rotor comprising the rotor blade, a two-part mould for injection moulding the rotor blade and rotor, and a method of injection moulding the rotor blade and rotor.

BACKGROUND

A turbomolecular pump (or 'turbo pump'), is a type of vacuum pump that typically includes rapidly rotating rotor blades to help create a vacuum. As the rotor blades spin, they hit and push gas molecules from an inlet of the pump downstream towards further pump stages and an exhaust in order to create or maintain a vacuum in a particular system or space. In order to generate the desired levels of vacuum, the rotor blades can be required to rotate at high speeds, such as 10,000 to 100,000 rpm.

Rotor blades of this type have typically been manufactured from aluminium alloys, which provide the low weight and high strength required to operate at these high rotational speeds. However, such rotor blades are normally quite simply shaped, as it can be prohibitively difficult and expensive to provide more complex blade geometries using such production processes and materials. Such complex geometries could be used to improve the pumping performance of the turbomolecular pump if they could be reliably and more cost-effectively implemented.

Therefore, there is a need for a lightweight rotor blade for a turbomolecular pump with more complex blade geometries that is simpler and more cost-effective to manufacture.

The discussion above is merely provided for general background information and is not intended to be used as an aid in determining the scope of the claimed subject matter. The claimed subject matter is not limited to implementations that solve any or all disadvantages noted in the background.

SUMMARY

From one aspect, the present disclosure provides a rotor blade for a turbomolecular vacuum pump. The rotor blade comprises a span extending from a root to a tip, a chord extending from a leading edge to a trailing edge, and a blade angle defined between the chord and a radial plane parallel to an axis of rotation of the rotor blade. The blade angle is 0° at the root. The blade angle increases along the span. The rotor blade tapers from a maximum thickness at the root to a point of minimum thickness over a portion of the span. The rotor blade is made of a polymer material reinforced with short fibres.

The span extends from 0% span at the root to 100% span at the tip along a radial axis relative to the axis of rotation (i.e., the central axis along which the rotor blade protrudes from the root to tip).

The blade angle increasing continuously along the span leads to the rotor blade having 'twist' (i.e., being twisted about the radial axis along which it extends).

Short fibres in this context refer to reinforcement fibres which are negligible in size with respect to the size of the polymer matrix of into which they are introduced. They are distinct from so-called long or continuous fibres, which are usually laid up in directionally aligned layers and are similar in length to the polymer matrix. In this manner, short fibres may be alternatively referred to as 'chopped fibres' (i.e., long fibres which have been chopped to provide short fibres).

The rotor blade being made of a polymer material reinforced with short fibres allows the rotor blade to be manufactured using an injection moulding process, and permits more complex geometry rotor blades to be made in a simple and cost-effective manner. The more complex geometry permits the blades to have lower weight with improved (or at least comparable) pumping performance and strength compared to previous rotor blades.

The 0° blade angle at the root improves the strength and mouldability of the rotor blade. For example, it increases the strength of the rotor blade at the root so it can be removed from a mould during manufacture with less risk of breaking. It may also allow for the maximum clearance to be present between adjacent rotor blades at the root. This reduces the need for thin or sharp knife edges in the mould which may be too thin to withstand the manufacturing conditions and thus be prone to damage/breakage prematurely after only a short number of moulds.

The continual blade twist provided by the increasing blade angle allows simpler and more reliable manufacture of the rotor blade using a two-part mould. It also reduces the amount of sharp corners in the mould reducing the risk of air being trapped and material not fully filling the mould during the injection moulding process. This can also reduce the tendency for the mould to break during the process. The twist can also be used to define a more aerodynamic shape for the rotor blades (e.g., compared to an untwisted blade).

The rotor blade tapering from a maximum thickness at the root to a point of minimum thickness over a portion of its span may provide the rotor blade with maximum strength at the root to handle the increased stresses at the root during moulding and high-speed operation of the rotor, while reducing the overall mass of the rotor blade.

The twist and tapering portion combine to provide improved pumping efficiency/performance for the rotor blade, as they can provide a more aerodynamic blade geometry with higher molecular flow efficiency (e.g., providing a more favourable geometry for gas molecules to collide with the rotor blade and be moved downstream thereof during operation).

In an embodiment of the above, the thickness of the rotor blade is constant from the point of minimum thickness to the tip.

This may minimise the mass of the rotor blade whilst retain sufficient strength for the high rotational speed operations required by a turbomolecular pump.

In an embodiment of any of the above, the point of minimum thickness may be between 20% and 40% span.

This may provide the optimal balance between high strength at the root and lower mass across the span as a whole. In one example, the minimum thickness is at 25% span.

In an embodiment of any of the above, the maximum thickness may be at least 3.5 mm.

In an embodiment of any of the above, the minimum thickness may be at least 2.0 mm.

These values may provide the lowest mass blade possible while ensuring sufficient structural strength for the rotor blade to handle the injection moulding process as well as stresses from the high rotational speeds experienced in use.

In an embodiment of any of the above, the thickness may decrease continuously over the portion of tapering thickness.

This may optimise the balance between strength and mass across the tapering portion for the rotor blade and improve pumping performance.

In an embodiment of any of the above, a length of the chord may increase continuously along substantially the entire span (i.e., substantially from the root to the tip).

In this manner, the rotor blade can be said to 'fan out' as it extends between the root and the tip. This may increase pumping performance by reducing the gaps between adjacent rotor blades, thereby reducing the probability of gas molecules leaking back upstream through the rotor blades during pumping operations.

In an embodiment of any of the above, the rotor blade further includes a filleted region extending along the leading edge at the area where the leading edge meets a forward blade surface of the rotor blade. In one embodiment, the filleted region extends across the whole length of the leading edge (i.e., along the whole span of the rotor blade from the root to the tip).

The filleted region blunts the area of the leading edge where it meets the forward blade surface so that when gas molecules collide with the filleted region they have an improved chance of being rebounded downstream of the rotor blade. This can improve pump performance. The filleted region may also reduce the sharpness of corners within the mould, which can otherwise reduce air that may become trapped therein during moulding and improve mould reliability and durability.

In an embodiment of any of the above, a radially outer surface at the tip is radiused. In this manner, the radially outer surface is rounded such that it conforms closer to a cylindrical surface of a turbomolecular pump when it is housed therein.

This may minimise the tip clearance and thus flow leakage between the tip of the rotor blade and the surface to improve pumping performance.

In an embodiment of any of the above, the polymer material may comprise (i.e., be reinforced with) 20%-40% short fibres by weight. In one example, the polymer material may comprise (i.e., be reinforced with) 30% short fibres by weight.

This can provide the optimal balance between mechanical strength, weight and production costs.

The short fibres may be one or a combination of carbon, glass or aramid fibres.

The polymer material may be one of polyamide 6 (PA6), Polyphthalamide (PPA), Polyimide (PI) or Polyether ether ketone (PEEK).

In one embodiment, the polymer material is one of PA6, PPA, PI or PEEK reinforced with 30% short carbon fibres by weight.

In an embodiment of any of the above, the total length of the span from the root to the tip is at least 70 mm. In other words, the length of the rotor blade is at least 70 mm.

This provides a relatively long blade length that may allow for higher rotational speed at the tip of the rotor blade, and thereby improve pumping performance by increasing the probability of the rotor blade colliding with the gas molecules and impelling them downstream during operation. This blade length can be achieved without exceeding operational stress limits due to the reduced weight and geometric characteristics of the rotor blade provided by the embodiments above.

From another aspect, the present disclosure provides a rotor comprising a hub and a plurality of the rotor blades according to any of above embodiments protruding therefrom. The rotor blades protrude radially from the hub.

In an embodiment of the above, a blade separation distance between the leading edges of adjacent rotor blades is at least 3.24 mm across the whole span of the rotor blades. This may avoid the formation of overly thin sections or edges in the mould which may be prone to damage under the moulding conditions. It also ensures the separation is large enough to ensure good pump performance (i.e., there is adequate chance for gas molecules to be swept between the adjacent rotor blades during rotation thereof).

In an embodiment of any of the above, a radially outer surface of the hub is filleted between the roots of adjacent rotor blades.

The filleted portions of the hub may reduce stress concentrations at the root of the rotor blades. This may ensure that the rotor can handle the stresses caused by the very high rotational speeds experienced during use.

In an embodiment of any of the above, the plurality of rotor blades are formed integrally with hub. Thus, the rotor may be formed as a single unitary structure.

This may make the manufacturing more simple and efficient by reducing the number of steps in the process to make the full rotor. This may also reduce the risk of the structural strength of the rotor being compromised, e.g., by avoiding attachment points between rotor blades and the hub.

Alternatively, the plurality of rotor blades may each be formed separately from the hub and attached by any other suitable means (e.g., adhesive or mechanical interlock/interference fit).

From another aspect, the present disclosure provides a mould for injection moulding the rotor blade or rotor of any of the above embodiments, comprising two complementary mould halves that when pressed together define a cavity therebetween in the shape of the rotor blade or the rotor.

The geometry of the rotor blade ensures there are no overhanging features in the direction that the mould opens, and allow for easier moulding and removal of the moulded blade. It also allows for a mould which is less susceptible to wear or breakage during use, as it comprises fewer thin portions and sharp edges. Similarly, there may be a lower risk of air getting trapped in sharp corners, thereby improving fill. By having the rotor blade geometry enable a more reliable two-part mould injection moulding process, the manufacture of the rotor blade or rotor can be quicker and more cost-effective.

From another aspect, the present disclosure provides a method of injection moulding any of the above rotor blade or rotor embodiments using the above mould. The method comprises pressing the two halves of the mould together to define a cavity therebetween in the shape of the rotor blade or the rotor; injecting molten polymer material with short fibres dispersed therein into the cavity; and solidifying the polymer material to form the rotor blade or the rotor. The solidifying can include cooling and applying pressure to the mould halves. Curing processes during the solidifying can also be performed.

This provides a simple and cost effective method of producing a rotor blade or rotor for a turbomolecular pump having the advantageous weight and rotor blade geometry features discussed above.

Although certain advantages have been discussed in relation to certain features above, other advantages of certain features may become apparent to the skilled person following the present disclosure.

The Summary is provided to introduce a selection of concepts in a simplified form that are further described in the Detailed Description. This summary is not intended to identify key features or essential features of the claimed subject matter, nor is it intended to be used as an aid in determining the scope of the claimed subject matter.

BRIEF DESCRIPTION OF THE DRAWINGS

Some exemplary embodiments and features of the present disclosure will now be described by way of example only, and with reference to the following drawings in which.

DETAILED DESCRIPTION

Figure 1:
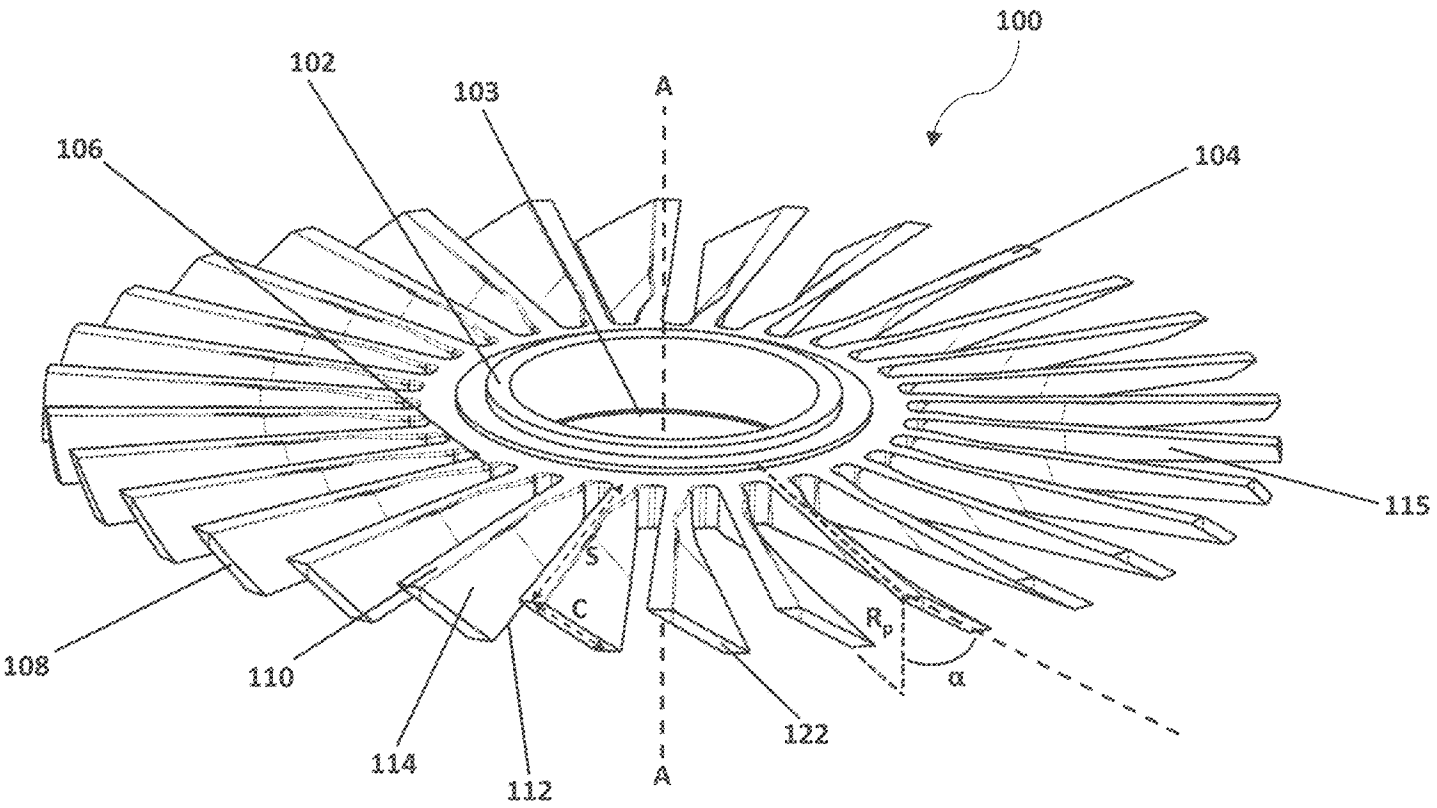
FIG. 1 shows a perspective view of a rotor in accordance with an embodiment of the present disclosure.

With reference to FIG. 1, a rotor 100 for a turbomolecular pump is shown in accordance with an embodiment of the present disclosure. The rotor 100 comprises a rotor hub 102 having a central axis A about which the rotor 100 is configured to rotate. A bore 103 through the centre of the rotor hub 102 is configured to engage with a rotatable shaft of a turbomolecular pump to provide the rotation during operation. A plurality of rotor blades 104 are spaced circumferentially around the rotor hub 102 and extend radially therefrom.

The rotor blades 104 are manufactured from a polymer material reinforced with short fibres (i.e., a short fibre reinforced polymer composite). In one example, the polymer matrix material used is Polyphthalamide (PPA) due to its relatively low cost. However, any other suitable polymer may be used, such as Polyamide 6 (PA6), Polyimide (PI) or Polyether Ether Ketone (PEEK), and the like.

The polymer matrix is reinforced with short fibres. Any suitable short fibres may be used, for example, carbon fibres, glass fibres, aramidic fibres, and the like. Short fibres in this context refer to fibres which are negligible in size with respect to the size of the polymer matrix of into which they are introduced. For example, the maximum length of the short fibres may be generally less than 10 mm, preferably less than 5 mm, and more preferably less than 1 mm. This is in contrast to using long reinforcing fibres, which are not negligible in size with respect to the size of the matrix of polymer material into which they are introduced. Short fibres may also be referred to as chopped fibres (i.e., as they can be formed by chopping up long fibres).

Reinforcing the polymer matrix with long fibres can be more complex and costly compared to using short fibres, as all the long fibres need to be laid up in particular orientations within the polymer matrix material. They are usually arranged in a predetermined direction of maximum stress for the component being produced so the fibres can best reinforce the component. While this increases the structural strength of the material, the complexity of orienting the long reinforcing fibres in the predetermined directions in a component with a complex shape leads to high productions cost and times.

In contrast, an advantage of reinforcing the polymer with short fibres is that due to their negligible size, they do not need to be oriented in any particular direction. Rather, they can simply be dispersed (e.g., in a substantially random manner) within the polymer matrix material. This significantly reduces the complexity of the manufacturing process, whilst still offering reinforcement to the polymer matrix. In particular, it allows the rotor blade 104 to be manufactured by known injection moulding processes. This reduces productions costs relative to an equivalent aluminium blades which are typically manufactured by more complex machining or casting processes. The resulting rotor blade 104 may also exhibit similar structural strength to an equivalent blade manufactured from an aluminium alloy, whilst being lighter.

The polymer matrix material may be reinforced using 20%-40% short fibres by weight. In one particularly suitable example, 30% short fibres by weight can be used. In one further particularly suitable example, the polymer matrix material can be reinforced with 30% short carbon fibres by weight.

It is thought the above examples provide a good balance between mechanical strength, weight and production costs for the rotor blade 104. Nonetheless, it is envisaged that the types and relative amounts of polymer matrix material and fibres can be readily varied to suit specific application requirements.

The rotor hub 102 may also be manufactured from a polymer material reinforced with short fibres. The rotor hub 102 may be manufactured from the same composite as the rotor blades 104, either integrally with the rotor blades 104 or formed separately and attached thereto by any suitable means. For example, the rotor hub 102 and the plurality of rotor blades 104 may be injection moulded as one integral or monolithic structure. It is thought this provides mechanical strength, as well as manufacturing efficiency benefits. Nonetheless, alternatively, the rotor blades 104 may be individually injection moulded and then each attached separately to the rotor hub 102, which may also be injection moulded. The rotor blades 104 can be attached by any suitable method, such as by being adhesively or mechanically bonded thereto.

Figure 3:
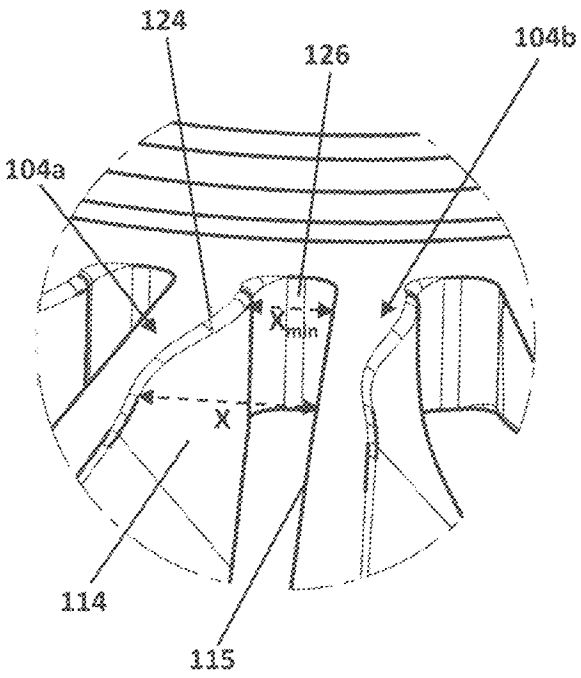
FIG. 3 shows a close-up, perspective view of the rotor hub area of the rotor of FIG. 1.
Figure 2:
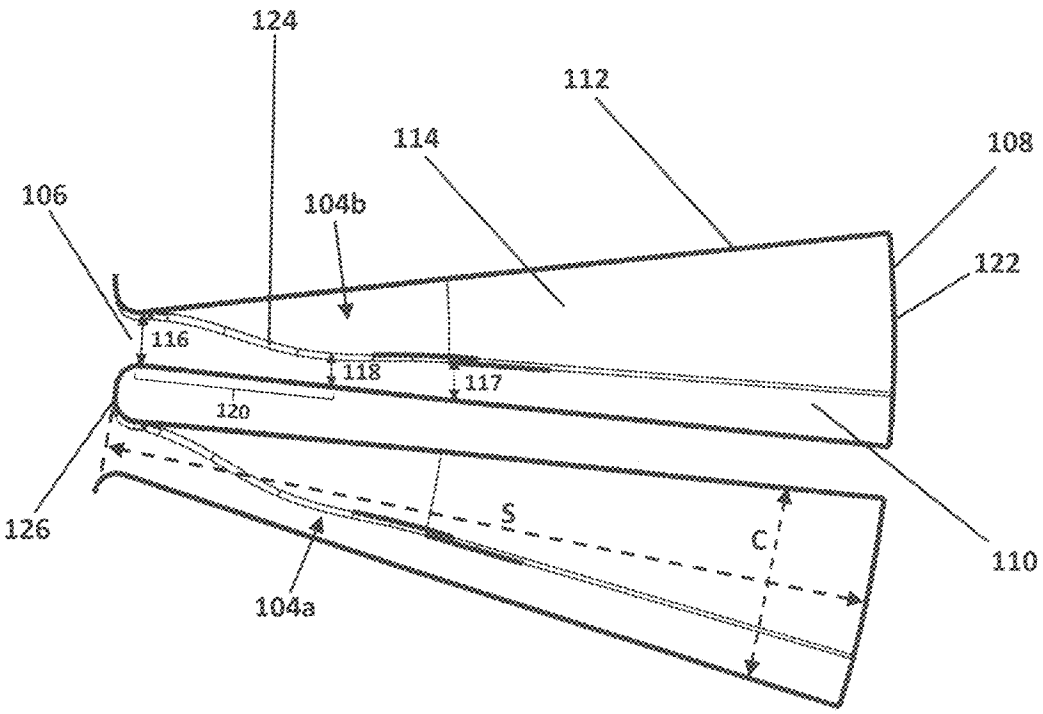
FIG. 2 shows a close-up, top view of two adjacent rotor blades of the rotor of FIG. 1.

With reference to FIGS. 1 to 3, the rotor blade 104 extends from a root 106 to a tip 108 to define a span S. The root 106 is at 0% span, and the tip 108 is at 100% span. Although the span S can be any suitable length, in particular embodiments, the span S may be at least 70 mm, for example, 80 mm, 90 mm, 100 mm, 110 mm, 120 mm or longer. This provides a relatively increased blade length that provides higher rotational speed at the tip of the rotor blade 104, and thereby improves pumping performance by increasing the probability of the rotor blade 104 colliding with a given gas molecule and impelling it downstream, thus increasing the number of successful collisions. Compared to known designs this increased blade length can be implemented (e.g., without exceeding operational stress limits) due to the reduced weight from the use of the short fibre reinforced polymer composite and the geometric characteristics of the rotor blade discussed below.

The rotor blade 104 extends from a leading edge 110 to a trailing edge 112, to define a chord C. In the depicted embodiment, the length of the chord C increases continuously along substantially the entire span(S) (i.e., from the root 106 to the tip 108). In this context, "substantially" means at least 90% of the span S. This may allow for a small portion, for example up to 10% of the span S adjacent the root 106 (e.g., 0%-10% or 0%-5% span) to exhibit a constant or non-increasing chord C. Nonetheless, in some embodiments the chord C may increases continuously from the root 106 at 0% span to the tip 108 (i.e., increase continuously from 0%-100% span).

The increasing chord C causes the rotor blade 104 to "fan out" along its span S. It is thought this can improve pumping efficiency/performance by reducing back leakage, i.e., by reducing gaps between adjacent rotor blades 104 to prevent gas molecules escaping back past the rotor blade 104.

The rotor blade 104 also defines a blade angle $\alpha$. As shown, the blade angle $\alpha$ is defined as the angle $\alpha$ between a radial plane $R_p$ extending parallel to the central axis A and the chord C. A different blade angle $\alpha$ is defined at each % span location depending on how the chord C is angled relative to the radial plane $R_p$ at that % span location.

At the root 106, the rotor blade 104 comprises a blade angle of 0°. In other words, at the root 106, the chord C of the rotor blade 104 is parallel to the central axis A about which the rotor blade 104 is configured to rotate. A blade angle of 0° at the root 106 improves mouldability. This is because it improves the strength at the root 106, such that it is easier for the finished blade to be removed from the mould with less risk of breaking. It also provides a larger clearance between the roots 106 of adjacent blades so wider portions of the mould can be employed between the blades. This means that the mould is less prone to breaking under the moulding conditions, and thus increases the reliability and lifetime of the mould.

The blade angle $\alpha$ increases continuously along substantially the entire span S. Again, in this context, "substantially" means at least 90% of the span S. This may allow for a small portion, for example up to 10% of the span S adjacent the root 106 (e.g., 0%-10% span or 0%-5% span) to exhibit a constant or non-increasing blade angle $\alpha$. In this manner, the blade angle $\alpha$ increases continuously from the root 106 at 0% span (or from the 0%-10% span portion) to the tip 108. This increasing blade angle results in a 'twist' of the rotor blade 104. In other words, the rotor blade 104 continually twists as it extends away from the root 106.

The continual blade twist may also make it easier for the rotor blade 104 to be removed from the mould once it is formed. In particular, it can prevent the formation of sharp edges in the mould that may be too thin and prone to breakage or trap air during the moulding process and inhibit mould filling.

At the tip 108, the blade angle $\alpha$ may be between 30° and 60°, for example 40°, 45°, 50°, 55°. This may be optimal for mouldability and also pumping performance.

The rotor blade 104 defines a thickness between a forward blade surface 114 and an aft blade surface 115. In the depicted embodiment, the rotor blade 104 comprises a maximum thickness 116 at the root 106. This may provide the maximum strength at the root 106, which is required to handle the increased stresses at the root 106 during moulding and during high-speed operation of the rotor 100. It has been found that in one example the maximum thickness 116 at the root 106 may be at least 3.5 mm.

The thickness of the rotor blade 104 decreases or tapers to a point of minimum thickness 118 over a portion 120 of its span S. The thickness may begin tapering from the root 106 (i.e., from 0% span). Alternatively, the maximum thickness 116 may be constant for a portion of the span S, for example 0%-10% or 0%-5% of the span S, after which point the thickness begins to taper.

The point of minimum thickness 118 may be located between 20% and 40% span, for example, at 20%, 25%, 30%, 35% or 40% span. As shown, the thickness may decrease continuously along the portion of tapering thickness 120 to the point of minimum thickness 118.

These examples may provide the blade 104 with a more optimal balance of strength near the root and reduced mass across the span S as a whole.

In one example it has been found that the minimum thickness 118 is to be at least 2.0 mm. This may provide the lowest mass possible while ensuring sufficient structural strength for the rotor blade 104 to handle the injection moulding process, as well as the loads generated by the high rotational speeds experienced in use.

In the depicted embodiment, the thickness of the rotor blade 104 is constant from the point of minimum thickness 118 to the tip 108. In other words, the minimum thickness 118 may extend from the point of minimum thickness 118 to the tip 108.

In another embodiment, the thickness of the rotor blade 104 increases along the span S after the point of minimum thickness 118 to an intermediate thickness 117 (shown in phantom) that is above the minimum thickness 118 but below that of the maximum thickness 116. The intermediate thickness 117 is then maintained to the tip 108. In one example, the thickness of the blade 104 is maintained at the intermediate thickness 117 from 30%-100% span, or from 40%-100% span or from 50%-100% span. As will be appreciated, this span range will depend on the % span location of the minimum thickness 118, as discussed above.

It will be appreciated that FIG. 2 is a 2D view of a twisting blade comprising both a blade angle $\alpha$ and a thickness which is changing along its span S, and so relative dimensions may not be accurately derivable therefrom. For example, while an intermediate thickness at point 117 is shown in phantom, this may be the same as the minimum thickness at point 118, and any visual difference in the thicknesses at these points may be illusory.

The thickness profiles of the rotor blade 104 embodiments discussed above can minimise the mass of the rotor blade, whilst ensuring there is sufficient material to cope with the loads experience during use.

At the tip 108, the rotor blade 104 defines a radially outer surface 122. The radially outer surface 122 may be radiused (i.e., rounded) such that it better conforms to the curvature of a duct/surface of a turbomolecular pump in which it is configured to rotate. This minimises the clearance between the tip 108 of the rotor blade 104 and the duct/pump surface to minimise leakage around the tip 108 and improve pumping performance. The radiusing of the radially outer surface 122 at the tip 108 can also avoid the use of sharp corners in the mould when defining the tip 108. This can improve mould filling/avoid air getting trapped in the corners during the manufacture process. The radius of curvature of the radiused/rounded tip can be varied according to the surface of the pump it is to conform to.

The leading edge 110 of the rotor blade 104 comprises a filleted region 124 that extends along its entire length (i.e., across the whole span S from root 106 to tip 108). The filleted region 124 extends along the leading edge 110 where it meets the forward blade surface 114. The filleted region 124 provides a blunted surface that can take any suitable form such as rounded/radiused or chamfered.

When gas molecules collide with the filleted region 124 they have an improved chance of being rebounded downstream of the rotor blade 104 than if the filleted region 124 was not present. Thus, the filleted region 124 can improve pump performance.

Furthermore, the filleted region 124 reduces the sharpness of the corners needed in the mould to define the rotor blade 104. This improves mould filling during manufacture as less air can get trapped therein, and this can also improve mould durability and reliability as stress concentrations in the mould are reduced.

In further examples, the rotor blade 104 may additionally or alternatively feature a blunting of any of the regions where the leading and trailing edges 110, 112 meet the forward or aft blade surfaces 114, 115. For example, a rounded region can extend the across the whole span S where the leading edge 110 meets the aft blade surface 115, where the trailing edge 112 meets the forward blade surface 114 and/or wherein the trailing edge 112 meets the aft blade surface 115.

As shown, the hub 102 can also include a filleted portion 126 that extends between the roots 106 of adjacent rotor blades 104*a*, 104*b*. In other words, the forward blade surface 114 of a first rotor blade 104*a* and the aft blade surface 115 of an adjacent second rotor blade 104*b* may be attached to the hub 102 via a filleted portion 126. In other words, the forward blade surface 114 of the first blade 104*a* is blended into the aft blade surface 115 of the second blade 104*b* via the filleted portion 126. This provides a smoother and rounded interface between the blades 104*a*, 104*b* and the hub 102. The filleted portion 126 is present between each pair of circumferentially adjacent rotor blades 104 protruding radially from the hub 102. The filleted portions 126 help reduce stress concentrations at the root 106 of each rotor blade 104. This helps the rotor blades 104 resist with the loads generated at the high rotational speeds experienced during pump operation.

A blade separation distance X is defined between the leading edges 110 of adjacent rotor blades 104*a*, 104*b*, and is kept at or above a minimum value $X_{min}$ over the whole span S of the blades 104*a*, 104*b* to avoid the formation of overly thin sections or edges in the mould which may be prone to damage under the injection moulding process conditions. In one example, it has been found that a suitable minimum blade separation distance $X_{min}$ is at least 3.24 mm. In the depicted embodiment, the minimum separation distance $X_{min}$ is found between the roots 106 of adjacent rotor blades 104*a*, 104*b*.

Figure 4:
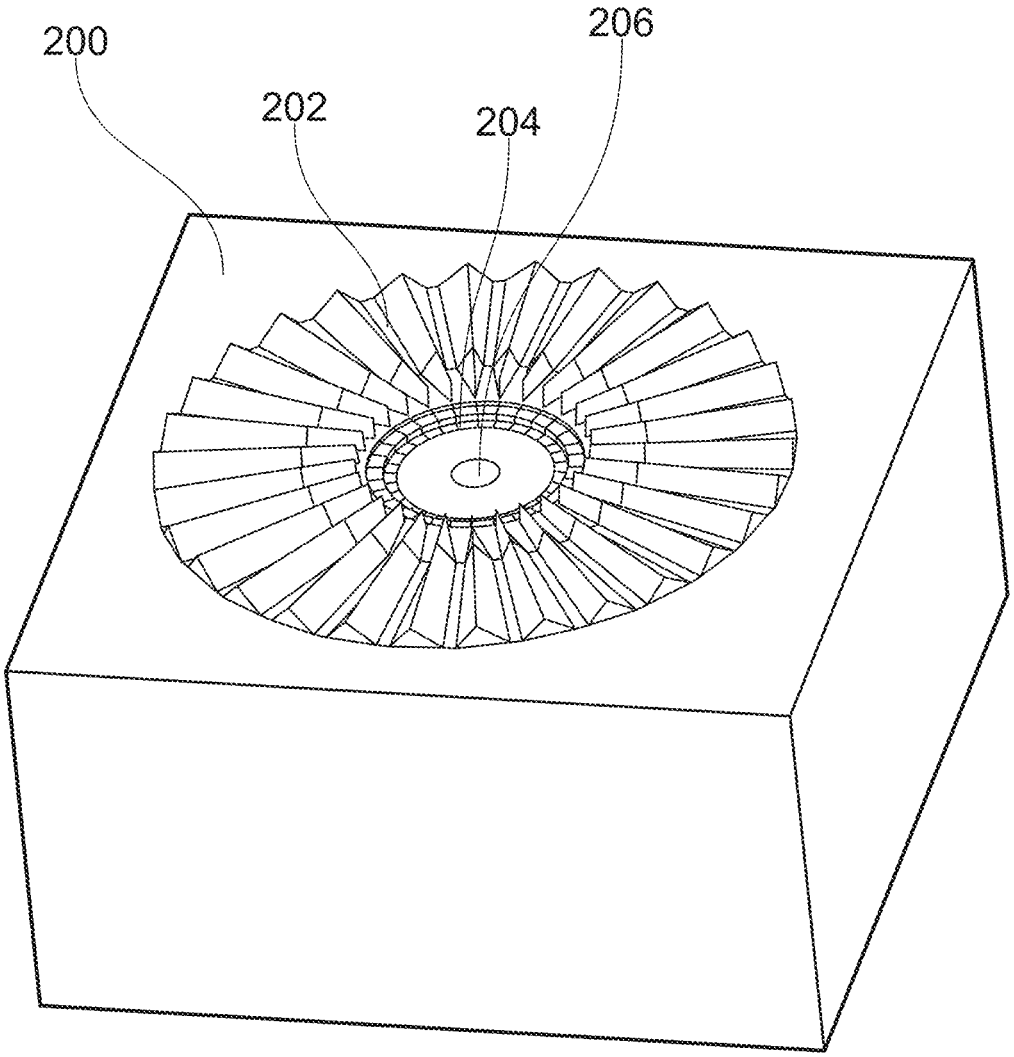
FIG. 4 shows a highly schematic perspective view of a mould half in accordance with an embodiment of the present disclosure.

With reference to FIG. 4, a schematic depiction of a mould half 200 for injection moulding the rotor 100 is depicted. The moulding half 200 comprises features 202 that are shaped to provide the geometry of the rotor blades 104 discussed above and a feature 204 that is shaped to provide the hub 102 that the rotor blades 104 are attached to. The features 202, 204 can be machined into the mould half 200 before use. The mould half 200 also includes a material injection passage 206 therein that is in fluid communication with the features 202, 204 and an exterior of the mould half 200.

As will be understood by the skilled person a complementary second mould half (not shown) having complementary features to those of the mould 200 will be pressed on top of the mould half 200 to define a cavity (or fluidly linked series of cavities) therein that will provide the shape of the rotor 100 and rotor blades 104 discussed above.

A known injector (not shown), such as a screw extruder, will be placed in fluid communication with the material injection passage 206. The polymer material and short fibres can be mixed and heated in the injector such that molten polymer material with the short fibres dispersed therein can be delivered (or injected) into the mould formed by the two complementary mould halves 200. The molten polymer material will fill the cavity(ies) in the mould and solidify to form the rotor 100 and rotor blades 104 that can then be removed by taking the two mould halves 200 apart.

As will be appreciated, a mould can be used to define the rotor 100 and plurality of rotor blades 104 as a single integral piece, or separate moulds can be used to define separate rotor blades 104 and other parts of the rotor 100 (e.g., the hub 102), which can later be assembled together.

The mould being formed in two parts (i.e., using two mould halves 200) may make it easier for the finished rotor blade 104 to be ejected from the mould.

The mould may be made of material suitable for the injection moulding process, for example steel.

As discussed above, the geometry of the rotor blade 104, and in particular the 0° root blade angle and the continual blade twist, ensures there are no overhanging features in the direction that the mould halves open, and allow for easier removal of the moulded blade. It may also allow for a mould which comprises fewer thin portions or sharp edges, thereby making it less susceptible to wear or breakage when subjected to the moulding conditions. This may make it less prone to trapping air in sharp corners when the mould is being filled, as well as ensuring there are fewer imperfections in the moulded rotor blade 104 and/or rotor 100.

Figure 5:
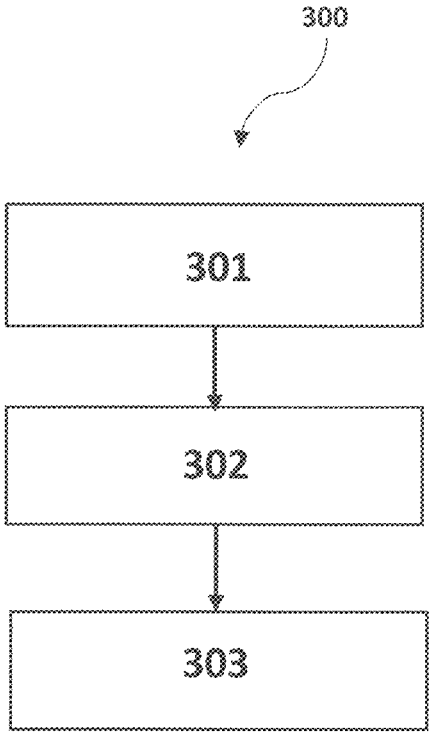
FIG. 5 shows a method of injection moulding a rotor or rotor blade using a mould in accordance with an embodiment of the present disclosure.

Short fibre reinforced polymer injection moulding processes are well known by the skilled person, and so do not warrant detailed discussion in this disclosure. Nonetheless, a general method 300 for injection moulding the aforementioned rotor blades 104 and/or rotor 100 using the aforementioned mould is depicted in FIG. 5. The method 300 comprises pressing the two halves of the mould together to define a cavity therebetween in the shape of the rotor blade or the rotor (step 301), injecting molten polymer material with short fibres dispersed therein into the cavity in molten form (step 302), and then solidifying the polymer material to form the rotor blade 104 or the rotor 100 (step 303). The finished rotor blade 104 or rotor 100 may then be removed from the mould by separating the two mould halves.

As the skilled person will be aware, depending on the materials and properties of the short fibre reinforced material required, a variety of curing treatments (i.e., pressure and heat treatments) can be applied during the solidifying step 303. As such steps will be part of known injection moulding processes they will not be discussed in more detail in this disclosure.

Although the figures and the accompanying description describe particular embodiments and examples, it is to be understood that the scope of this disclosure is not to be limited to such specific embodiments, and is, instead, to be determined by the following claims.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. A rotor blade for a turbomolecular vacuum pump, comprising:

a span extending from a root to a tip;

a chord extending from a leading edge to a trailing edge; and a blade angle defined between the chord and a radial plane parallel to an axis of rotation of the rotor blade;

wherein the blade angle is 0° at the root and increases continuously along substantially the entire span;

wherein the rotor blade tapers from a maximum thickness measured across the leading edge at the root to a point of minimum thickness measured across the leading edge over a portion of the span; and wherein the rotor blade is made of a polymer material reinforced with short fibres.

2. The rotor blade of claim 1, wherein the thickness is constant from the point of minimum thickness to the tip.

3. The rotor blade of claim 1, wherein the point of minimum thickness is located between 20% to 40% span.

4. The rotor blade of claim 1, wherein the maximum thickness is 3.5 mm and/or the minimum thickness is 2.0 mm.

5. The rotor blade of claim 1, wherein a length of the chord increases continuously along substantially the entire span.

6. The rotor blade of claim 1, including a filleted region extending along the leading edge across the span at the area where the leading edge meets a forward blade surface of the rotor blade.

7. The rotor blade of claim 1, wherein a radially outer surface at the tip is radiused.

8. The rotor blade of claim 1, wherein the total length of the span from the root to the tip is at least 70 mm.

9. The rotor blade of claim 1, wherein the polymer material comprises 20%-40% short fibres by weight.

10. A rotor for a turbomolecular vacuum pump comprising:

a hub; and a plurality of the rotor blades of claim 1 protruding from the hub.

11. The rotor of claim 10, wherein a blade separation distance between the leading edges of adjacent rotor blades is at least 3.24 mm across the whole span of the rotor blades.

12. The rotor of claim 10, wherein a portion of the hub is filleted between the roots of adjacent rotor blades.

13. The rotor of claim 10, wherein the plurality of rotor blades are formed integrally with hub.

14. A mould for injection moulding the rotor of claim 10, comprising two complementary mould halves that when pressed together define a cavity therebetween in the shape of the rotor.

15. A method of injection moulding using the mould of claim 14, the method comprising:

pressing the two mould halves of the mould together to define a cavity therebetween in the shape of the rotor;

injecting molten polymer material with short fibres dispersed therein into the cavity; and solidifying the polymer material to form the rotor.

16. A rotor blade for a turbomolecular vacuum pump, comprising:

a span extending from a root to a tip;

a chord extending from a leading edge to a trailing edge; and a blade angle defined between the chord and a radial plane parallel to an axis of rotation of the rotor blade;

wherein the blade angle is 0° at the root and increases continuously along substantially the entire span;

wherein the rotor blade tapers from a maximum thickness at the root to a point of minimum thickness over a portion of the span;

wherein a radially outer surface at the tip is radiused; and wherein the rotor blade is made of a polymer material reinforced with short fibres.

17. A rotor for a turbomolecular vacuum pump comprising:

a hub; and a plurality of the rotor blades protruding from the hub, each rotor blade of the plurality of rotor blades comprising:

a span extending from a root to a tip;

a chord extending from a leading edge to a trailing edge; and a blade angle defined between the chord and a radial plane parallel to an axis of rotation of the rotor blade;

wherein the blade angle is 0° at the root and increases continuously along substantially the entire span;

wherein the rotor blade tapers from a maximum thickness at the root to a point of minimum thickness over a portion of the span; and wherein the rotor blade is made of a polymer material reinforced with short fibres; and wherein a blade separation distance between the leading edges of adjacent rotor blades in the plurality of rotor blades is at least 3.24 mm across the whole span of the rotor blades.

* * * * *